United States Patent [19]

Stafford

[11] 4,223,483

[45] Sep. 23, 1980

[54] CLOSURE HINGE MECHANISM

[75] Inventor: Douglas J. Stafford, Grosse Pointe Woods, Mich.

[73] Assignee: Chrysler Corporation, Highland Park, Mich.

[21] Appl. No.: 23,127

[22] Filed: Mar. 23, 1979

[51] Int. Cl.[2] ..... E05F 1/10

[52] U.S. Cl. ..... 49/386; 49/250; 49/252

[58] Field of Search ..... 49/246, 250, 252, 260, 49/249, 386; 16/180

[56] References Cited

U.S. PATENT DOCUMENTS

| | | | |
|---|---|---|---|
| 3,332,169 | 7/1967 | Lohr et al. | 49/250 |
| 3,438,152 | 4/1969 | Cadiou | 49/386 |
| 3,747,271 | 7/1973 | Adamski | 49/386 X |

*Primary Examiner*—Kenneth Downey
*Attorney, Agent, or Firm*—Baldwin & Newtson

[57] ABSTRACT

A combination hinge and opening bias mechanism for a closure of a vehicle such as a trunk deck lid including a hinge arm attached at one end to the closure with the other end guided by a horizontal track extending beneath an adjacent backlite of the vehicle body. Movement of the end of the hinge arm in the track is controlled by the pivoting of a torsion bar which extends laterally across the closure and with the end of a crankarm portion attached in pivotal relation to the body. During opening movement, the hinged edge of the closure pivots upward and slightly rearward as the elongated portion of the torsion bar rotates about the crankarm end. This upward movement is accompanied by rearward movement of the hinge arm in the track. The simultaneous dual pivoting of the closure moves the hinged edge portion of the closure rapidly upwardly in a substantially vertical direction so as not to contact the adjacent backlite of the vehicle which is only slightly spaced forward thereof.

5 Claims, 3 Drawing Figures

CLOSURE HINGE MECHANISM

This invention relates to an improved combination hinge and opening biasing mechanism for a closure such as a trunk lid or a hood of a vehicle.

With the present emphasis on economical lighter weight vehicles, the long trunk and hoods common on vehicles a few years ago no longer exist. Previously, a trunk deck lid or closure was located to the rear of the vehicle backlite and a body panel filled the space between the backlite and the forward or hinged edge of the trunk lid. Consequently, corresponding hinge mechanisms usually permitted the hinged edge of the trunk lid to move upward and also forward toward the backlite. Because of the aforementioned fixed panel there was no problem with respect to interferring with the backlite. Present compact vehicles have shorter hoods and trunk decks and it is advantageous to eliminate the fixed body trim panel between the backlite and hinged edge of the trunk lid or closure in order to provide a maximum access opening to the trunk compartment. The present invention concerns a combination hinge and biasing mechanism to pivot the closure toward its open position. During the opening movement of the closure, the hinged edge moves substantially vertically upward and slightly rearward from the backlite of the vehicle. The movement of the closure is controlled by engagement between a hinge arm and a track. The track is located below the backlite of the vehicle and extends longitudinally with respect to the vehicle and in a horizontal direction. The deck lid pivots about a track follower on the hinge arm as the track follower moves rearward in the track. The movement in the track is generated by the unwinding pivotal movement of a torsion bar opening member. The torsion bar is attached to the closure and with a radially extending crankarm affixed to the vehicle body. During initial opening movement of the deck lid, the torsion bar unwinds to lift the hinged edge of the closure upward while initiating the sliding movement of the track follower rearward in the track. Final opening movement is provided by the remainder of the unwinding action of the torsion bar which causes the track follower to fully move to its final rearward position while the hinge arm and attached closure rotate thereabout. The torsion bar provides both an opening biasing force on the closure and a driving force to move the follower in the track to provide a sliding pivot. The resultant simultaneous dual pivoting permits the hinged edge of the closure to move upward and slightly rearward so as not to engage the backlite while the opposite edge pivots in a normal opening manner.

Therefore, an object of the present invention is to provide with a closure for a vehicle compartment, a mechanism including a hinge arm having a free end movable in a horizontal track to bodily shift the pivot of the trunk closure rearward which shifting is controlled by the unwinding of a torsion bar member which initially lifts the hinged edge of the closure upward and slightly rearward while also providing an opening force on the closure.

Further objects and advantages of the present invention will be more readily apparent after a reading of the following detailed description reference being had to the accompanying drawings in which a preferred embodiment is illustrated.

IN THE DRAWINGS

Figure 1:
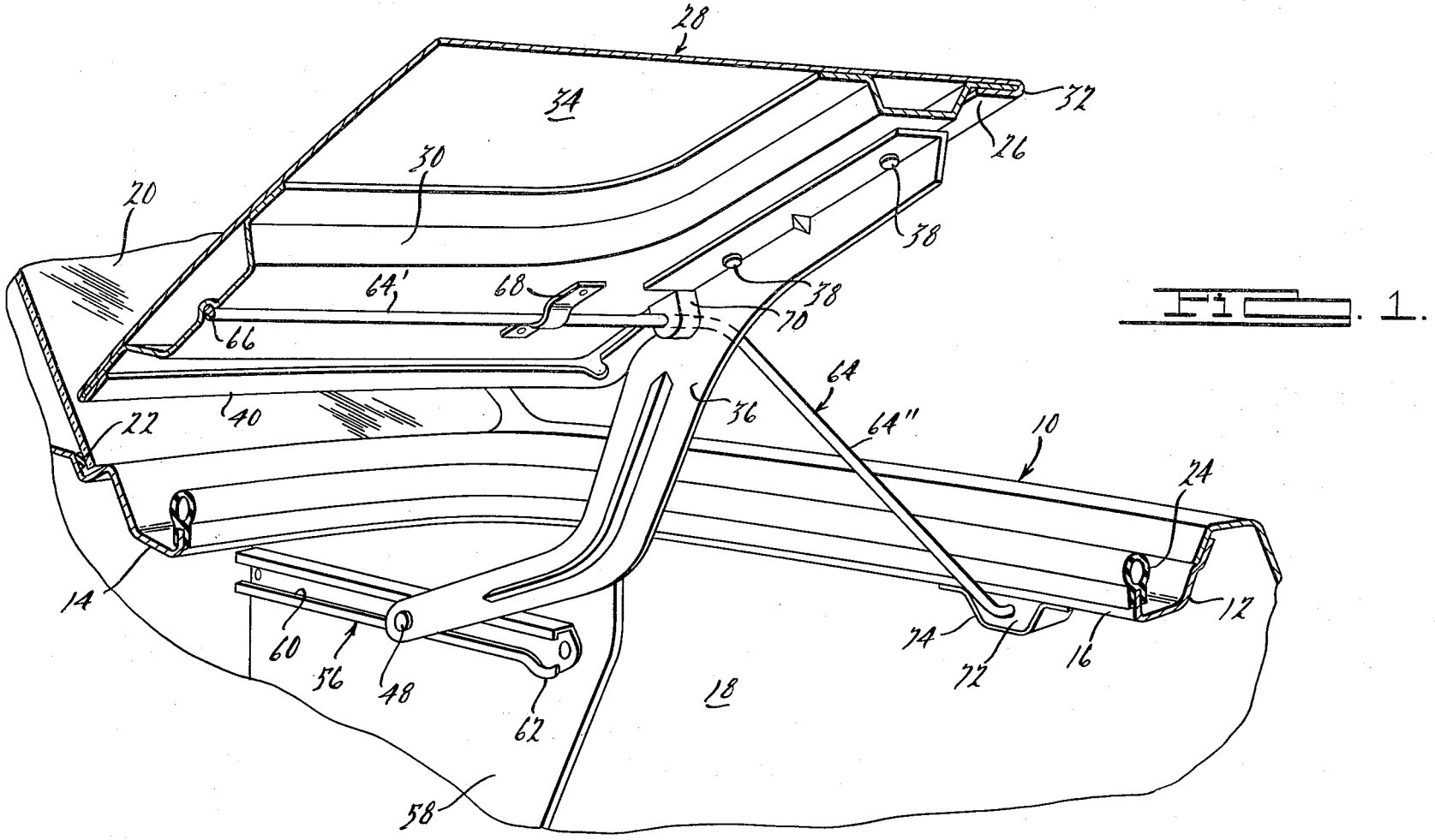
FIG. 1 is a fragmentary and perspective view of the hinge mechanism with a portion of the torsion bar in its mid-position between an open and closed operative mode.

In the drawings, portions of a vehicle body 10 are shown including side and forward flange portions 12 and 14 which frame an opening 16 to a compartment 18. The illustrated compartment 18 is the trunk compartment of the vehicle and the opening 16 is the access opening thereto which is substantially horizontal in extent. Forward of the opening 16 is a backlite or rear window 20 of the vehicle which extends substantially in a vertical plane from the base formed by the framing member 14. Gasket 22 between the backlite 20 and the body portion 14 prevents leakage therebetween. Forming a frame about opening 16 and continuously engaging portions 12 and 14 is a generally tubular gasket member 24. Tubular member 24 engages a surface 26 around the periphery of a closure member 28 shown in FIG. 1 in the partially open position but also shown in a fully open and a closed position in FIG. 2. Closure 28 includes a stiffening member 30 extending along the forward edge portion thereof and also along the sides. The member 30 is engaged by a continuous folded over edge portion 32 whose undersurface 26 engages the seal 24 when the closure 28 is in the closed position.

Figure 3:
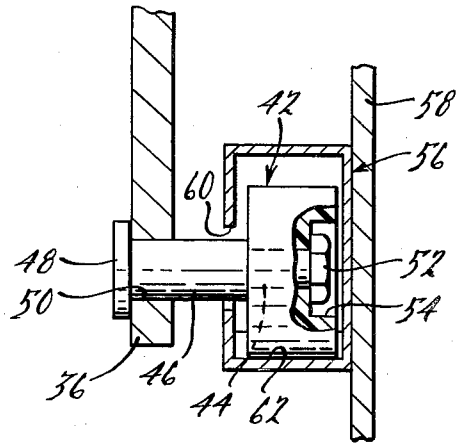
FIG. 3 is a sectioned view taken along section line 3—3 in FIG. 2.

Hinge arm means 36 (only the righthand arm illustrated) are attached by rivet-like fasteners 38 to the member 30 of the closure 28 at locations rearward of the forward edge portion 40. The hinge arm 36 extends downwardly and forwardly through the opening 16 and has a track following roller 42 attached at its forward end. The roller 42 is best shown in FIG. 3 and in a preferred embodiment is made of molded nylon material which exhibits high abrasion and wear resistance combined with low friction. Specifically, the roller 42 is mounted upon a reduced diameter shaft 44 of a support 46. The support 46 is attached to the hinge arm 36 and has an enlarged head 48 and is press fit through a bore 50. At the other end of the support, a nut fastener 52 threads upon the reduced diameter portion 44 and is seated in a recess 54 within roller 42. From FIG. 3 it can be most readily observed that the roller 42 travels in a generally U-shaped guide-track 56 which is attached to wall 58 of the vehicle. The track means 56 comprises a nearly four-sided box-like structural element with a slot 60 formed longitudinally therein for the passage of the support 46. The ends of the guide track 56 are open as can be seen in FIG. 1 with the rearward end portion having a downwardly curved bottom wall portion 62 contoured so that when the roller 42 has moved completely to its most rearward position in the track, it drops slightly into a curved recess to attain a final pivot position for the closure 28 and arm 36.

Figure 2:
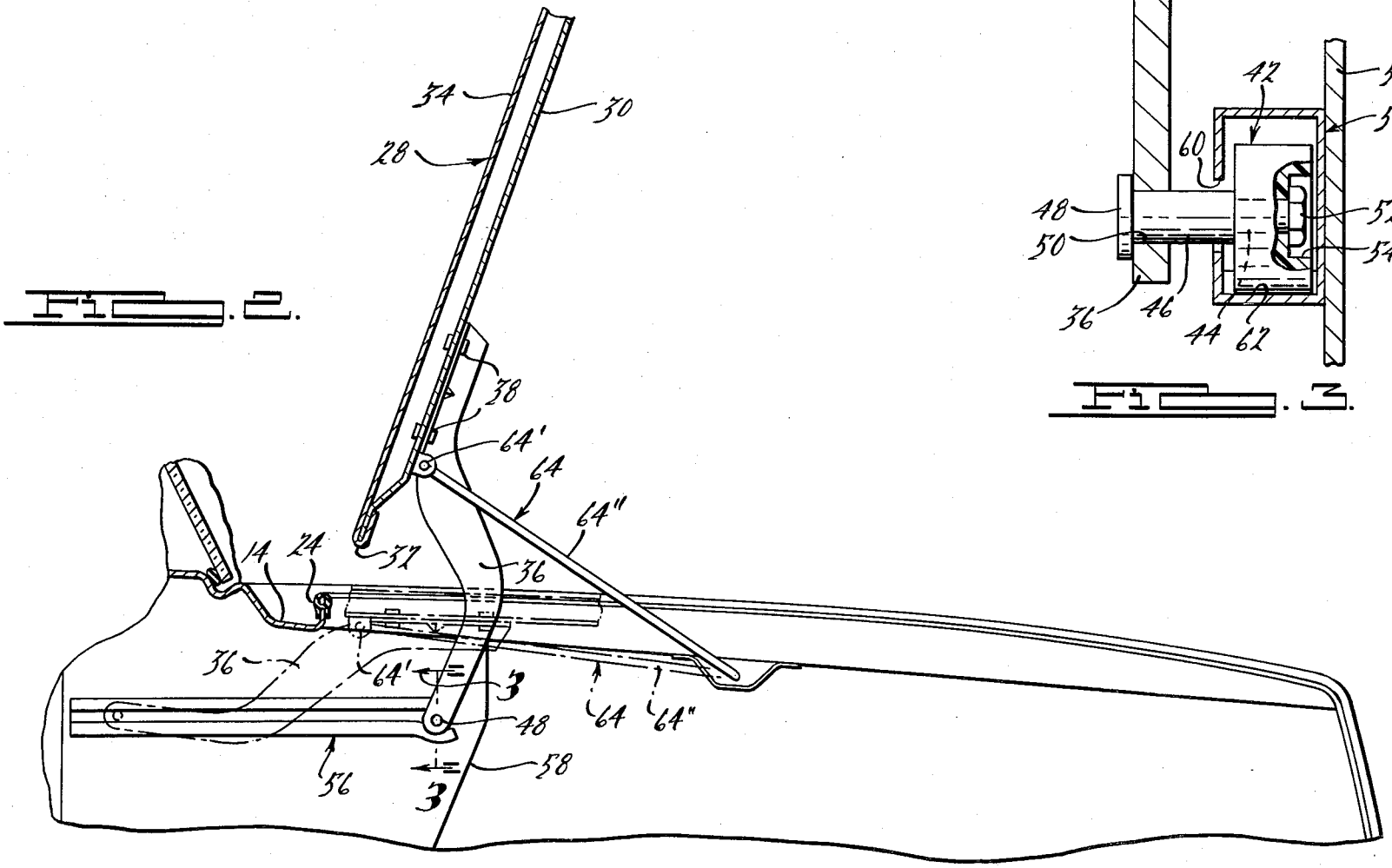
FIG. 2 is an elevational sectioned view of the hinge mechanism shown in an open mode in solid lines and in a closed mode in broken lines.

It is obvious from the drawings that the roller 42 is moved rearwardly in the track 56 as the closure opens. This movement is controlled by the unwinding pivotal movement of a torsion bar type opening assist member 64. Member 64 has an elongated portion 64' and a radially extending crankarm portion 64''. The end of the elongated portion 64' extends to the left in FIG. 1 and an end which is not visible is affixed to the member 30 to prevent its rotation. From the affixed end portion, the elongated portion 64' extends laterally across the vehicle in a channel or groove 66. A strap member 68 holds the elongated portion 64' to the frame member 30 but does not prevent rotation thereof as the torsion bar is twisted. Adjacent the crank portion 64'', a nylon bushing 70 supportingly engages the torsion bar 64 and permits relatively frictionless rotation of the elongated portion therein. The end of the crankarm 64'' extends into a second nylon bushing member 72 held to the body member 12 by a metal housing or strap 74. As can be seen in FIG. 2, the elongated portion 64' of the torsion bar 64 is twisted in the counterclockwise rotational direction as the closure 28 is pivoted downward from the open position to the closed position. Simultaneously to the counterclockwise winding of the elongated portion 34', the track follower 42 on the end of the hinge arm 36 is moved upwardly from the depressed lower portion of the rearward end of track 64 and then forwardly beneath the vehicle backlite. With reference to FIG. 2, the position of the hinge arm 36 is shown in broken lines when the closure 28 is in its closed covering position over opening 16. Also note the relative position of the crankarm 64'' and the elongated portion 64' of the torsion bar 64 in the closed operative mode.

Although only one embodiment of the subject invention has been illustrated and described heretofore, modifications and variations will readily come to mind of a person skilled in the art which modifications and variations do not fall outside the scope of the invention as defined hereinafter.

I claim:

1. A combination hinge mechanism and opener for a closure adapted to pivot between open and closed operative modes with respect to an opening in a vehicle body comprising: hinge arms attached at first end portions to the closure and extending therefrom through the vehicle opening and beneath one edge portion thereof; a pair of tracks supported beneath the one edge portion and extending in a generally horizontal orientation; one track follower on each other end portion of the hinge arms engaging a respective track and providing a moving pivot for the closure; torsion bar means between the closure and the vehicle to provide an opening force on the closure and to provide a second pivot for imparting an upwardly bodily shifting motion to the closure in cooperative relation with the track follower as it moves beneath the one edge portion; the torsion bar means including an elongated portion and a radially extending crankarm portion, the end of the elongated portion being fixedly supported in a non-rotative manner to permit twisting and untwisting of the elongated portion as the closure is respectively closed and opened, the end of the crankarm portion being rotatively supported so that as the closure moves between closed and open operative modes the hinged closure edge is bodily shifted away from the one edge portion as the hinge arm enclosure pivot about the torsion bar simultaneously with lineal movement of the track follower in the track.

2. In combination, a vehicle having a window and body members immediately adjacent the window which define an opening to a compartment, a closure covering the opening when in a closed operative mode and having an edge extending adjacent the window, hinging and opening means for the closure to bodily move the adjacent edge upward and away from the window while generally pivoting the closure from a closed to an open operative position, the hinging and opening means including a hinge arm attached at one end portion to the closure and extending through the opening and beneath the window, a track supported by the vehicle and extending beneath the window and in a generally horizontal direction, track follower means between a second end portion of the hinge arm and the track to provide a movable pivotal support for the hinge arm and closure, a torsion bar member including an elongated portion with one end affixed to the closure in a manner preventing rotations thereof and a radially extending crankarm portion located adjacent the other end of the torsion bar which is engaged by the vehicle adjacent the opening therein in a manner permitting rotation about an axis generally parallel with the elongated portion whereby upon moving the closure between open and closed operative modes, the torsion bar alternatively twists and untwists to provide a force on the closure tending to open same and simultaneously pivots about the crankarm end to bodily shift the adjacent edge upward and away from the window while causing the track follower means to move from one end of the track to the other, thus providing a rearwardly sliding pivot for the closure.

3. In a vehicle having window means located adjacent body portions of the vehicle which define an access opening to a compartment such as a luggage compartment, an improved combination hinge and opening bias mechanism for a closure characterized by simultaneous pivoting and bodily shifting movement of the closure with respect to the access opening and the window preventing interference between the window and an adjacent hinged forward edge portion of the closure, comprising: guide track means supported by the vehicle and extending beneath the lower edge portion of the window in a horizontal and longitudinal orientation with respect to the vehicle; an elongated hinge arm with one end portion fixedly secured to the closure near the forward edge thereof and extending downwardly and forwardly through the access opening when the closure is in its closed covering position thereto; a track follower supported by the other end portion of the hinge arm and engaging the guide track means to provide a horizontally sliding pivotal support for the hinge arm and closure; torsion bar means between the closure and the vehicle including an elongated member with one end affixed to prevent rotative movement and with the other end formed into a crank portion extending radially from the elongated portion for twisting the elongated portion; means supporting the torsion bar at a location near the one end portion of the hinge arm member and in a manner exerting an opening force on the closure as the torsion bar untwists whereby upward pivotal and bodily shifting movement of the closure takes place about the elongated portion of the torsion bar and the rearwardly moving point of engagement between the track follower and the guide track as controlled by unwinding movement of the torsion bar about the end of the crank arm.

4. The hinge mechanism and opener of claim 1 in which the elongated portion extends laterally across the vehicle adjacent the first end portions of the hinge arms and has its end fixedly supported to the closure, and the end of the crankarm extends into a vehicle body mounting to permit the closure and elongated portion to pivot thereabout along with the follower support thusproviding dual means for pivoting and bodily shifting the closure.

5. A combination hinge and opening mechanism for a closure which is movable from a closed position in which a closure edge lies adjacent a stationary edge portion of an opening to an open position in which the closure edge moves upwardly and away from the stationary edge portion, comprising:

a hinge arm with one end portion affixed to the closure adjacent the closure edge and with an opposite end portion extending from the closure edge and downward through the opening;

a stationary track located beneath the stationary edge portion;

a track follower on the opposite end portion of the hinge arm engaging the track in sliding relation to bodily shift the hinge arm and closure away from the stationary edge portion during an opening operation;

torsion bar means improving an elongated twist portion and a laterally offset crank arm portion, the closure supporting the end of the twist portion in one nonrotative fixed fashion for torsional twisting thereabout;

means near the midpoint of the hinge arm engaging the twist portion of the torsion bar adjacent the crank arm portion in a manner permitting the elongated twist portion to move therein;

stationary support means engaging the end of the crank arm to permit rotation therein thus requiring the closure and twist portion to pivot upward during the opening operation simultaneously accompanied by movement of the track follower in the stationary track resulting in overall movement of the closure edge upward and away from the stationary edge portion in bodily shifting fashion.

* * * * *